US009804521B2

(12) United States Patent
Taniguchi et al.

(10) Patent No.: US 9,804,521 B2
(45) Date of Patent: Oct. 31, 2017

(54) IMAGE FORMING APPARATUS OPERABLE IN PLURAL SPEEDS AND HAVING SELECTIVE CONTROL OF SEPARATION BETWEEN IMAGE BEARING MEMBER AND BELT

(71) Applicant: CANON KABUSHIKI KAISHA, Tokyo (JP)

(72) Inventors: Hisashi Taniguchi, Suntou-gun (JP); Yoshihiro Mitsui, Numazu (JP); Yusuke Jota, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/076,702

(22) Filed: Mar. 22, 2016

(65) Prior Publication Data

US 2016/0291516 A1 Oct. 6, 2016

(30) Foreign Application Priority Data

Mar. 31, 2015 (JP) ..... 2015-072439

(51) Int. Cl.

| | |
|---|---|
| ***G03G 15/00*** | (2006.01) |
| ***G03G 15/01*** | (2006.01) |
| ***G03G 21/00*** | (2006.01) |

(52) U.S. Cl.

CPC ..... *G03G 15/0136* (2013.01); *G03G 15/5008* (2013.01); *G03G 2215/0132* (2013.01); *G03G 2215/0193* (2013.01)

(58) Field of Classification Search

CPC ..... G03G 15/5008; G03G 15/0131; G03G 15/0136; G03G 21/0011; G03G 2215/0193; G03G 2215/0132

USPC ..... 399/66, 299, 82, 302

See application file for complete search history.

(56) References Cited

U.S. PATENT DOCUMENTS

| | | | | |
|---|---|---|---|---|
| 5,893,017 | A | 4/1999 | Yamamoto | |
| 2006/0127139 | A1* | 6/2006 | Ogata | G03G 15/0136 399/299 |
| 2007/0292170 | A1* | 12/2007 | Yoshioka | G03G 15/0131 399/299 |
| 2010/0008689 | A1* | 1/2010 | Iwasaki | G03G 15/5008 399/66 |
| 2010/0129104 | A1* | 5/2010 | Ogata | G03G 15/0136 399/66 |

FOREIGN PATENT DOCUMENTS

| | | |
|---|---|---|
| JP | 10207151 A | 8/1998 |

* cited by examiner

*Primary Examiner* — Sophia S Chen

(74) *Attorney, Agent, or Firm* — Fitzpatrick, Cella, Harper & Scinto

(57) ABSTRACT

A positional relationship between a photosensitive drum and an intermediate transfer belt during a period from the start of the driving of the photosensitive drum to the start of image formation, or during a period of the end of the image formation to the stop of the driving of the photosensitive drum enters a separating state in a case where the image formation is executed when the process speed is a first speed, and enters a contacting state in a case where the image formation is executed when the process speed is a second speed.

21 Claims, 4 Drawing Sheets

IMAGE FORMING APPARATUS OPERABLE IN PLURAL SPEEDS AND HAVING SELECTIVE CONTROL OF SEPARATION BETWEEN IMAGE BEARING MEMBER AND BELT

BACKGROUND OF THE INVENTION

Field of the Invention

The present invention relates to an image forming apparatus, such as a copier and a printer, that includes a function to form an image on a recording material, such as a sheet of paper.

Description of the Related Art

An electrophotographic system has been used for an image forming apparatus, such as a copier and a page printer. In an electrophotographic system, a toner image formed on a photosensitive drum (image bearing member) is transferred onto a recording material, such as paper, using electrostatic force, and the toner image is melted and adhered (fixed) onto the recording material by heat and pressure applied by a fixing unit, whereby the image is formed on the recording material. Recently high level functions, that involve color and high speed, have been used in electrophotographic type image forming apparatuses, and a color image forming apparatus based on an electrophotographic process having an intermediate transfer belt is widely used to support these high level functions.

A concern of such an image forming apparatus is that if the photosensitive drum is constantly in contact with the intermediate transfer belt, the surface of the photosensitive drum wears by the contact with the intermediate transfer belt.

A proposal to solve this problem is a configuration to minimize the abrasion of the photosensitive drum by separating a belt portion of the intermediate transfer belt, which faces the photosensitive drum that does not perform the image forming operation, away from the photosensitive drum when the intermediate transfer belt is cleaned or when a monochrome image is formed (Japanese Patent Application Laid-open No. H10-207151).

SUMMARY OF THE INVENTION

Means to Solve the Problem

However, in the case of the above mentioned image forming apparatus having a separating mechanism, the following problem may occur if the image forming apparatus is disposed in a low temperature environment for a long time, which causes hardening of a rubber of a cleaning member to clean the surface of the photosensitive drum.

In other words, if driving of the photosensitive drum is started in a state where the photosensitive drum and the intermediate transfer belt are separated, a cleaning member may cause stick-slip and hit the photosensitive drum depending on the peripheral speed of the photosensitive drum, and an abnormal sound may be generated.

With the foregoing in view, it is an object of the present invention to reduce the abnormal sound generated between an image bearing member and a cleaning member to clean the surface of the image bearing unit.

An object of the present invention is to provide an imaging forming apparatus comprising:

an image bearing member configured to bear a developer image;

a cleaning member that is disposed so as to contact with the image bearing member and is configured to clean a surface of the image bearing member;

a belt member that is disposed so as to be able to contact with or separate from the image bearing member, and forms a transfer portion together with the image bearing member when contacting with the image bearing member; and contacting and separating means for setting a positional relationship between the belt member and the image bearing member to be a contacting state, where the belt member and the image bearing member contact with each other, or a separating state, where the belt member and the image bearing member separate from each other, wherein image formation is able to be executed in a plurality of modes in which peripheral speed of the image bearing member is different each other, the image formation is executed after driving of the image bearing member is started, and the driving of the image bearing member is stopped after the image formation is ended, the imaging forming apparatus further comprising:

control means for controlling the contacting and separating means so that the positional relationship between the image bearing member and the belt member, during a period from the start of the driving of the image bearing member to the start of the image formation, or during a period from the end of the image formation to the stop of the driving of the image bearing member, enters the separating state in a case where the image formation is executed when the peripheral speed of the image bearing member is a first peripheral speed, and enters the contacting state in a case where the image formation is executed when the peripheral speed of the bearing member is a second peripheral speed, which is different from the first peripheral speed.

Another object of the present invention is to provide an image forming apparatus comprising:

an image bearing member configured to bear a developer image;

a cleaning member that is disposed so as to contact with the image bearing member and is configured to clean a surface of the image bearing member;

a transfer member that is disposed so as to be capable of contacting with or separating from the image bearing member, and forms a transfer portion together with the image bearing member when contacting with the image bearing member; and contacting and separating means for setting a positional relationship between the transfer member and the image bearing member to be a contacting state where the transfer member and the image bearing member contact with each other, or a separating state where the transfer member and the image bearing member separate from each other, wherein image formation is able to be executed in a plurality of modes in which peripheral speed of the image bearing member is different each other, the image formation is executed after driving of the image bearing member is started, and the driving of the image bearing member is stopped after the image formation is ended, the image forming apparatus further comprising control means for controlling the contacting and separating means so that the positional relationship between the image bearing member and the transfer member, during a period from the start of the driving of the image bearing member to the start of the image formation, or during a period from the end of the image formation to the stop of the driving of the image bearing member, enters the separating state in a case where the image formation is executed when the peripheral speed of the image bearing member is a first peripheral speed, and enters the contacting state in a case where the image formation is executed when the peripheral speed of the image bearing member is a second peripheral speed, which is different from the first peripheral speed.

Further features of the present invention will become apparent from the following description of exemplary embodiments with reference to the attached drawings.

DESCRIPTION OF THE EMBODIMENTS

Embodiments of the present invention will now be described with reference to the drawings. Dimensions, materials, shapes and relative positions of components stated in the embodiments, however, should be appropriately changed depending on the configuration and various conditions of the apparatus to which the present invention is applied, and are not intended to limit the scope of the invention to the following embodiments. In the embodiments, a major portion related to forming/transferring a toner image (developer image) will be primarily described, but the present invention can be carried out for various applications, including various types of printers, copiers, facsimile machines and multifunctional machines, by adding the necessary apparatuses and a case structure.

Example 1

(General Configuration of Image Forming Apparatus)

Figure 1:
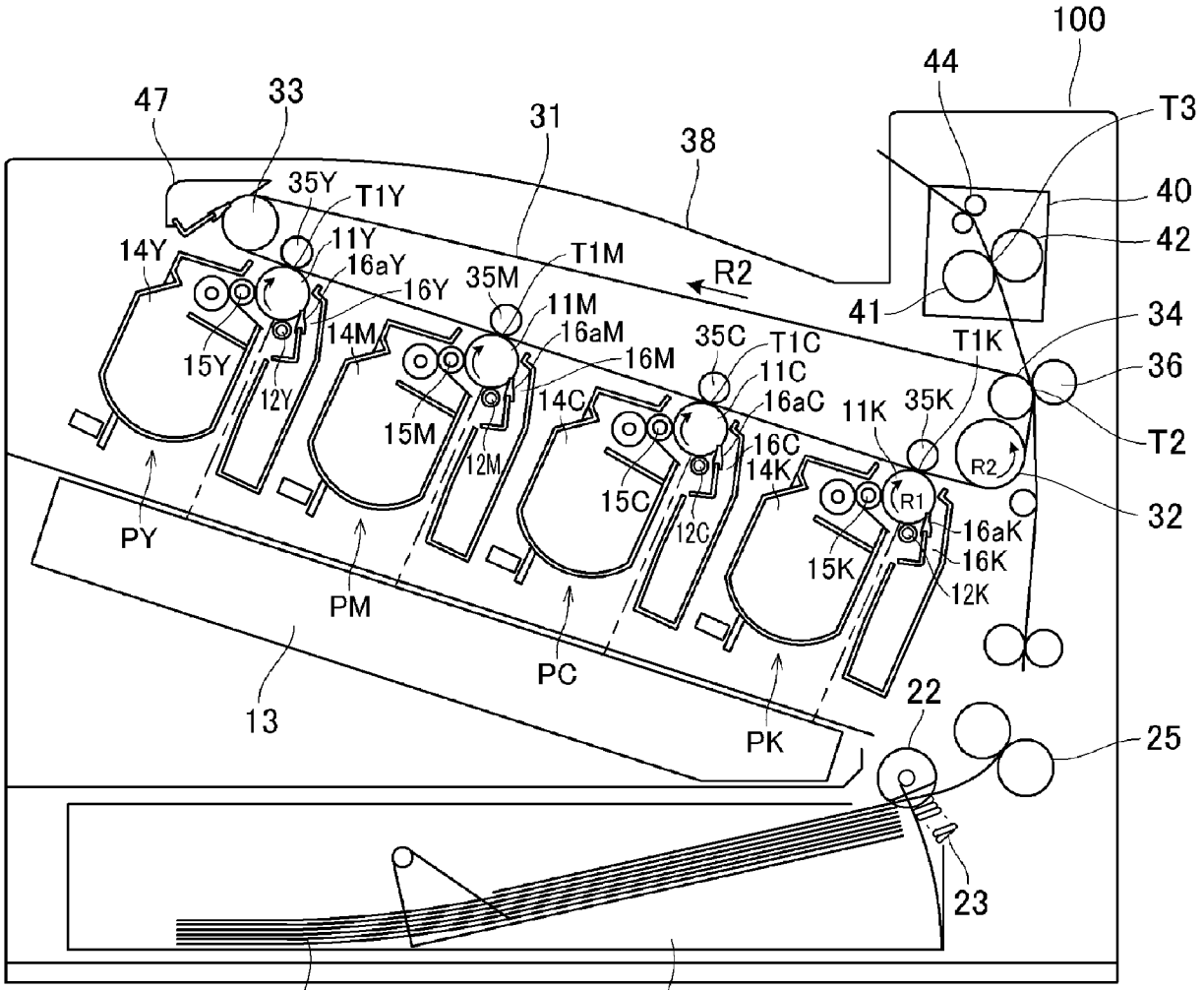
FIG. 1 is a schematic cross-sectional view depicting a general configuration of an image forming apparatus of Example 1.

FIG. 1 is a schematic cross-sectional view depicting a general configuration of an image forming apparatus according to this example. As shown in FIG. 1, the image forming apparatus 100 of this example is a tandem type full color copier, where four image forming portions, PY, PM, PC and PK, are disposed in a linear section of an intermediate transfer belt 31, which is used as a belt member. The four image forming portions, PY, PM, PC and PK, are disposed in this order from upstream to downstream, along the rotating (moving) direction of the intermediate transfer belt 31.

A photosensitive drum 11, which is used as an image bearing member that bears a toner image (developer image), and a primary transfer roller 35, which is used as a primary transfer member, are disposed in each image forming portion so as to face each other respectively via the intermediate transfer belt 31. The photosensitive drum 11 and the primary transfer roller 35 contact each other via the intermediate transfer belt 31, whereby a primary transfer portion T1 is formed between the photosensitive drum 11 and the intermediate transfer belt 31.

The primary transfer roller 35 and the intermediate transfer belt 31 can be contacted with and separated from the photosensitive drum 11 (contactable/separable). In this example, when the primary transfer roller 35 is separated from the photosensitive drum 11, the intermediate transfer belt 31 is also separated from the photosensitive drum 11.

In the image forming portion PY, a yellow toner image is formed on the photosensitive drum 11Y, and the yellow toner image on the photosensitive drum 11Y is primarily transferred to the intermediate transfer belt 31 by a primary transfer portion T1Y. In the image forming portion PM, a magenta toner image is formed on the photosensitive drum 11M, and the magenta toner image on the photosensitive drum 11M is primarily transferred to the intermediate transfer belt 31 by a primary transfer portion T1M, so as to be superimposed on the yellow toner image. In the image forming portion PC, a cyan toner image is formed on the photosensitive drum 11C, and the cyan toner image on the photosensitive drum 11C is primarily transferred to the intermediate transfer belt 31 by a primary transfer portion T1C, so as to be superimposed on the yellow toner image and the magenta image. In the image forming portion PK, a black toner image is formed on the photosensitive drum 11K, and the black toner image on the photosensitive drum 11K is primarily transferred to the intermediate transfer belt 31 by a primary transfer portion T1K, so as to be superimposed on the yellow toner image, the magenta toner image and the cyan toner image.

The four-color toner image, which was primarily transferred to the intermediate transfer belt 31, is carried to a secondary transfer portion T2 and secondarily transferred to a recording material S in bulk by the secondary transfer portion T2. At this time, the recording material S is fed from a feeding cassette 21 one sheet at a time, and sent to the secondary transfer portion T2 by a resist roller 25.

The recording material S on which the toner image was secondarily transferred by the secondary transfer portion T2 is heated and pressed by a fixing apparatus 40, so as to fix the toner image on the surface of the recording material, and is then discharged to a discharging tray 38 by a discharging roller 44.

A separating apparatus 23 individually separates the recording material S that a pickup roller 22 fed from the feeding cassette 21, which can load various sizes of recording material S, and feeds [each separated sheet of recording material S] to the resist roller 25. The resist roller 25 receives and holds the recording material S in a stopping state, and bears and carries the recording material S and feeds the recording material S to the secondary transfer portion T2, so as to match the timing of the toner image on the intermediate transfer belt 31.

The intermediate transfer belt 31 is an endless belt constituted by 80 μm thick polyimide resin, bears the toner image which was primarily transferred by the primary transfer portion T1, and carries the toner image to the secondary transfer portion T2 where the secondary transfer to the recording material S is performed. The length of the primary transfer portion T1 of the intermediate transfer belt 31 in the rotation axis direction of the photosensitive drum 11 is 250 mm.

The intermediate transfer belt 31 is supported by a stretching roller 33, a driver roller 32, and a backup roller 34, is driven by a pulse motor (not illustrated), and rotates in the arrow R2 direction at a predetermined process speed corresponding to the type of the recording material.

In the image forming apparatus 100 of this example, two modes, of which process speed is different from each other, can be set, and image formation can be executed with selecting one of the two modes. The process speed is set to 200 mm/sec (hereafter called "first speed") corresponding to such a recording material as standard paper, or 60 mm/sec (hereafter called "second speed") corresponding to such a recording material as heavy paper. Here the process speed is the same as the peripheral speed of the photosensitive drum 11. In this example, the peripheral speed of the photosensitive drum 11 is also the same as the peripheral speed of the intermediate transfer belt 31, but the present invention is not limited to this.

Each primary transfer roller 35 and each photosensitive drum 11 contact via the intermediate transfer belt 31, whereby a nip is formed, and the primary transfer portion T1 is formed between each photosensitive drum 11 and the intermediate transfer belt 31.

Each primary transfer roller 35 is formed to have a 16 mm outer diameter and a 17 to 23 degree hardness (Asker-C) where a surface layer of urethane sponge, in which an ion conductive agent is dispersed and the resistance value is adjusted to $5\times10^7\Omega$, covers a core bar having an 8 mm diameter.

When DC voltage, having a polarity (positive polarity in this example) which is the opposite of the original charging polarity of the toner, is applied to each primary transfer roller 35, a toner image charged in a predetermined original polarity (negative polarity in this example) on each photosensitive drum 11 is primarily transferred to the intermediate transfer belt 31.

A secondary transfer roller 36, which is used as a secondary transfer member, is disposed so as to press against the backup roller 34 via the intermediate transfer belt 31. Thereby the secondary transfer portion T2 is formed between the intermediate transfer belt 31 and the secondary transfer roller 36. In the secondary transfer portion T2, the recording material S is borne and carried so as to be superimposed on the toner image on the intermediate transfer belt 31.

When voltage having a positive polarity is applied from a power supply (not illustrated) to the secondary transfer roller 36, the negatively charged toner image on the intermediate transfer belt 31 is secondarily transferred to the recording material S. The backup roller 34 bends the circulating path of the intermediate transfer belt 31 at the downstream side of the secondary transfer portion T2, so as to separate the recording material S adhering to the intermediate transfer belt 31 by curvature-separation.

A belt cleaning apparatus 47 removes untransferred toner which remains on the intermediate transfer belt 31 after passing through the secondary transfer portion T2, so as to prepare for the next primary transfer.

In the fixing apparatus 40, a pressure roller 42 is pressed against a heat roller 41, in which a thermo-heater is disposed at the center, by the energizing force of a spring, whereby a fixing portion T3 is formed.

In the fixing portion T3, the recording material S, on which the toner image was secondarily transferred by the secondary transfer portion T2, is borne and carried, and the toner image is fixed on the surface of the material S by heat and pressure.

The image forming portions PY, PM, PC and PK will be described next.

The configuration and operation of each image forming portion is virtually the same, except that the color of toner (developer) to be used is different. Therefore unless a distinction is especially necessary, elements of each image forming portion are described in general without attaching the Y, M, C and K color indicators in FIG. 1, which indicate the color (yellow, magenta, cyan or black) for which the respective element is disposed.

As shown in FIG. 1, the image forming portion P is constituted by a charging apparatus 12, an exposing apparatus 13, the developing apparatus 14, the primary transfer roller 35 and a cleaning apparatus 16, which are disposed around the photosensitive drum 11. In this example, the photosensitive drum 11, the charging apparatus 12, the developing apparatus 14 and the cleaning apparatus 16 are integrated into a process cartridge, as shown in FIG. 1, and this process cartridge is configured to be detachable from the main body of the image forming apparatus 100. However, the present invention is not limited to this configuration, but the developing apparatus or the cleaning apparatus itself may be configured to be detachable from the main body of the image forming apparatus.

The photosensitive drum 11 is constituted by an aluminum cylinder of which diameter is 30 mm, and a photosensitive layer which is formed on the outer peripheral surface of the cylinder, and has negative charging polarity. In this example, the cylinder is connected to a ground potential.

The photosensitive drum 11 is supported at both ends by flanges so as to be rotatable, where the driving force is transferred from a driving motor (not illustrated) to one end in the rotation axis direction, and rotates the photosensitive drum 11 in the arrow R1 direction at a predetermined process speed.

The charging apparatus 12 uniformly charges the surface of the photosensitive drum 11 to the potential of the predetermined polarity (negative polarity in this example) using a charging roller which presses against the photosensitive drum 11 and rotates together. Since the charging apparatus 12 of this example is a contact charging type, the photosensitive drum 11 is uniformly charged to the charging voltage that is applied to the charging roller.

The surface layer of the charging roller is formed to be a 1 to 2 mm thickness using conductive rubber, in which a conductive agent such as carbon black is dispersed and of which resistance value is adjusted to $10^5$ to $10^7$ Ωm. The charging roller contacts the photosensitive drum 11 without any gaps, due to the elasticity of the surface layer. Thereby the generation of uneven charging can be reduced.

The exposing apparatus 13 scans an ON-OFF modulated laser beam on the scanning line image data generated by developing the separated color image of each color using a polyhedron mirror, and writes the latent image (electrostatic latent image) on the surface of the charged photosensitive drum 11.

The developing apparatus 14 supplies the negatively charged toner to the photosensitive drum 11, and allows the toner to adhere to the exposed portion of the latent image formed on the photosensitive drum 11, whereby the latent image is reversely developed. In the developing apparatus 14, a developing roller 15, which bears toner in the thin film state, is disposed so as to rotate with the photosensitive drum 11 in the same direction.

The developing roller 15 is constructed by fixing a conductive elastic layer (base layer) on the outer peripheral surface of the core bar, and the conductive elastic layer (base layer) is constituted by a rubber molded body of which major component of the material is silicon rubber. The hardness (Asker-C) of this rubber molded body is set to a 15 to 70 degree range. Further, a conductive surface layer (surface layer) is laminated on the outer peripheral surface of the conductive elastic layer, and this conductive surface layer is formed of polyurethane.

The cleaning apparatus 16 removes the untransferred toner, which passed through the primary transfer portion T1 and remained on the surface of the photosensitive drum 11.

The cleaning apparatus 16 of this example is a counter blade type, and is configured such that a cleaning blade 16*a*, which is used as a cleaning member, rubs the photosensitive drum 11 in the counter direction of the rotating direction of the photosensitive drum 11. The cleaning blade 16*a* is a 3 mm thick elastic blade of which major component is urethane, and is pressed against the photosensitive drum 11 at about a 40 g/cm linear pressure, and has a 10 mm free length.

The toner is non-magnetic one-component toner manufactured by an emulsion polymerization method, and has a property of charging to a negative polarity by triboelectric charging. The volume-average particle diameter of the toner is 6 μm, and includes silicon oxide (silica) particles as the external additive, and titanium oxide particles as the conductive external additive, which has a higher conductivity than the external additive.

The image forming operation of each image forming portion will now be described.

When an image forming instruction is received in the standby state, the image forming apparatus 100 drives each driving apparatus, starts the exposing apparatus, starts the fixing apparatus, and starts the high voltage applying sequence. At this time, the control portion (control means) of the image forming apparatus 100 transmits a signal to instruct each driving apparatus to start the driving, and in this example, it is assumed that the driving of the photosensitive drum 11 starts at the point when this signal is transmitted.

The photosensitive drum 11, the primary transfer roller 35, the intermediate transfer belt 31 and the like start to rotate, respectively, at a predetermined process speed. In this rotation step, the photosensitive drum 11 is uniformly charged to a potential of the negative polarity by the charging apparatus 12.

A latent image based on the image information is formed on the surface of the charged photosensitive drum 11 by a laser beam from the exposing apparatus 13. In this example, it is assumed that the timing, when the exposing apparatus 13 irradiates the laser beam onto the photosensitive drum 11, is the start of the image formation.

The toner inside the developing apparatus 14 is charged to negative polarity, and is borne by the developing roller, and voltage of negative polarity is supplied to the developing roller.

When the photosensitive drum 11 rotates and the latent image formed on the photosensitive drum 11 reaches the opposing portion (developing portion) which faces the developing roller, the latent image is visualized by the toner having the negative polarity, and a toner image having a color corresponding to each image forming portion is formed on the photosensitive drum 11.

Then the voltage of positive polarity is applied to the primary transfer roller 35 of each image forming portion, whereby a toner image having each color, Y, M, C and K, is primarily transferred in sequence onto the intermediate transfer belt 31, and a four-color toner image is formed on the intermediate transfer belt 31, as mentioned above.

In this example, it is assumed that the image formation ends when this primary transfer step ends.

After the primary transfer step, the untransferred toner remaining on the photosensitive drum 11 is removed and collected by the cleaning apparatus 16. Then in the secondary transfer portion N2, the four-color toner image on the intermediate transfer belt 31 is secondarily transferred to the recording material S in bulk. After the secondary transfer step, the recording material S is carried to the fixing apparatus 40 so as to fix the toner image, and is then discharged to the discharging tray 38 as imaged matter (print, copy).

After the secondary transfer step ends, the driving of the photosensitive drum 11, the primary transfer roller 35 and the intermediate transfer belt 31 stops. At this time, the control portion of the image forming apparatus 100 transmits a signal to stop driving to each driving apparatus, which drives the photosensitive drum 11, the primary transfer roller 35 and the intermediate transfer belt 31. This signal may be preset so as to be transmitted at the timing of the end of the secondary transfer step, or a sensor for detecting a recording material which passed the secondary transfer portion T2 may be installed so that this signal is transmitted based on the detection result of this sensor.

When the imaged matter is discharged normally to the discharging tray 38, the image forming apparatus 100 returns to the standby state.

In the image forming apparatus 100 of this example, the image formation is executed after the driving of the photosensitive drum 11 is started, and the driving of the photosensitive drum 11 is stopped after the image formation, as mentioned above.

Now the positional relationship of the photosensitive drum 11, the primary transfer roller 35 and the intermediate transfer belt 31 will be described.

In this example, the positional relationship of the photosensitive drum 11 and the intermediate transfer belt 31 can be switched between the contacting state in which the photosensitive drum 11 and the intermediate transfer belt 31 are contacted with each other, and the separating state in which the photosensitive drum 11 and the intermediate transfer belt 31 are separated from each other.

In the case of the image forming apparatus 100 of this example, a driving mechanism is installed so as to move the primary transfer roller 35 in the direction to contact with the photosensitive drum 11 or in the direction to separate from the photosensitive drum 11 via the intermediate transfer belt 31. By the primary transfer roller 35 moving away from the photosensitive drum 11 using this driving mechanism, the intermediate transfer belt 31 contacting the photosensitive drum 11 between the primary transfer roller 35 and the photosensitive drum 11 is also separated from the photosensitive drum 11. Here the portion of the primary transfer roller 35 and the portion of the driving mechanism that can move the primary transfer roller 35 correspond to the contacting and separating means.

For the driving mechanism, a known mechanism can be used, and, for example, a core bar of the primary transfer roller 35 is supported to be rotatable by a bearing member, and this bearing member is installed to be movable in a frame of the image forming apparatus 100. The movement of the bearing member is preferably controlled by the control portion of the image forming apparatus 100.

Thus this example is configured such that the contacting state in which the intermediate transfer belt 31 and the photosensitive drum 11 are contacting, and the separating state in which the intermediate transfer belt 31 is separated from the photosensitive drum 11 can be switched by the control means, which controls the movement of the primary transfer roller 35. Further, in this example, the primary transfer roller 35 and the intermediate transfer belt 31 are separated from the photosensitive drum 11 before the driving of the photosensitive drum 11 is started and after the driving of the photosensitive drum 11 is stopped, in order to minimize wear of the photosensitive drum 11.

Characteristics of this Example

A characteristic of the image forming apparatus 100 of this example is that the following control is performed if the process speed is the second speed (60 mm/sec) when image formation is executed on the recording material S. That is, the contacting operation is executed in the primary transfer roller 35 and the photosensitive drum 11 before the driving is started, and the driving of the primary transfer roller 35 and the photosensitive drum 11 is started respectively in the state where the primary transfer roller 35 and the photosensitive drum 11 are contacted via the intermediate transfer belt 31. When the image formation ends, the driving of the intermediate transfer belt 31, the primary transfer roller 35 and the photosensitive drum 11 is stopped respectively in the contacting state, and then the separating operation is executed for the primary transfer roller 35, whereby the photosensitive drum 11 and the intermediate transfer belt 31 are separated from each other.

In this example, the timings of the contact and separation of the primary transfer roller 35 and the photosensitive drum 11 are controlled to be different depending on whether the process speed is the first speed or the second speed. In the case of the second speed, the driving of the intermediate transfer belt 31, the primary transfer roller 35 and the photosensitive drum 11 is in the stopping state when the contacting operation or the separating operation of the primary transfer roller 35 with/from the photosensitive drum 11 is executed.

In the case when the process speed is the first speed (200 mm/sec), the primary transfer roller 35 and the intermediate transfer belt 31 are separated from the photosensitive drum 11 unless it is when the image formation is executed, in order to minimize wear of the photosensitive drum 11.

is stopped. At this time, the linear pressure of the cleaning blade to the photosensitive drum was set relatively high, in order to improve the cleaning capability of the cleaning blade.

A durability test (two sheets at intermittent printing) was performed in a 15° C. and 10% Rh evaluation environment (low temperature and low humidity environment, hereafter referred to as "L/L") by intermittently (two sheets at a time) printing 20,000 sheets of horizontal lines (1% image ratio), and when the 20,000 sheets are printed, three sheets of all white images were formed in the first speed mode and in the second speed mode. Here the image ratio is a ratio of an area of a toner image with respect to the total area of the recording material where the toner image could be transferred.

Table 2 shows the contacting or the separating state between the intermediate transfer belt 31/the primary transfer roller 35 and the photosensitive drum 11 when the process speed is the first speed and the second speed. In Table 2, the first mode is a mode when the positional relationship between the intermediate transfer belt 31/the primary transfer roller 35 and the photosensitive drum 11 is in the contacting state when the driving is started and when the driving is ended. The second mode is a mode when the positional relationship between the intermediate transfer belt 31/the primary transfer roller 35 and the photosensitive drum 11 is in the separating state when the driving is started and when the driving is ended.

In the comparative example, the mode is the second mode regardless whether the process speed is the first speed or the second speed, but in this example, the second mode is selected when the process speed is the first speed, and the first mode is selected when the process speed is the second speed.

TABLE 2

| | First speed (200 mm/sec) | | | Second speed (60 mm/sec) | | |
|---|---|---|---|---|---|---|
| | Driving start | During image formation | Driving stop | Driving start | During image formation | Driving stop |
| Comparative example | Separate | Contact Second mode | Separate | Separate | Contact Second mode | Separate |
| This example | Separate | Contact Second mode | Separate | Contact | Contact First mode | Contact |

The experiment results will be shown below to describe the effect of this example.

First as shown in the determination criteria in Table 1, the level of abnormal sound generated between the cleaning blade 16*a* and the photosensitive drum 11 by the stick-slip of the cleaning blade 16*a* is specified by the auditory sense.

TABLE 1

| Level | Auditory sense | Criteria |
|---|---|---|
| A | no abnormal sound | ○ |
| B | abnormal sound is heard when standing in front of (within 1 m from) the image forming apparatus | X |
| C | abnormal sound is heard when standing 3 m or more from the image forming apparatus | XX |

Figure 2:
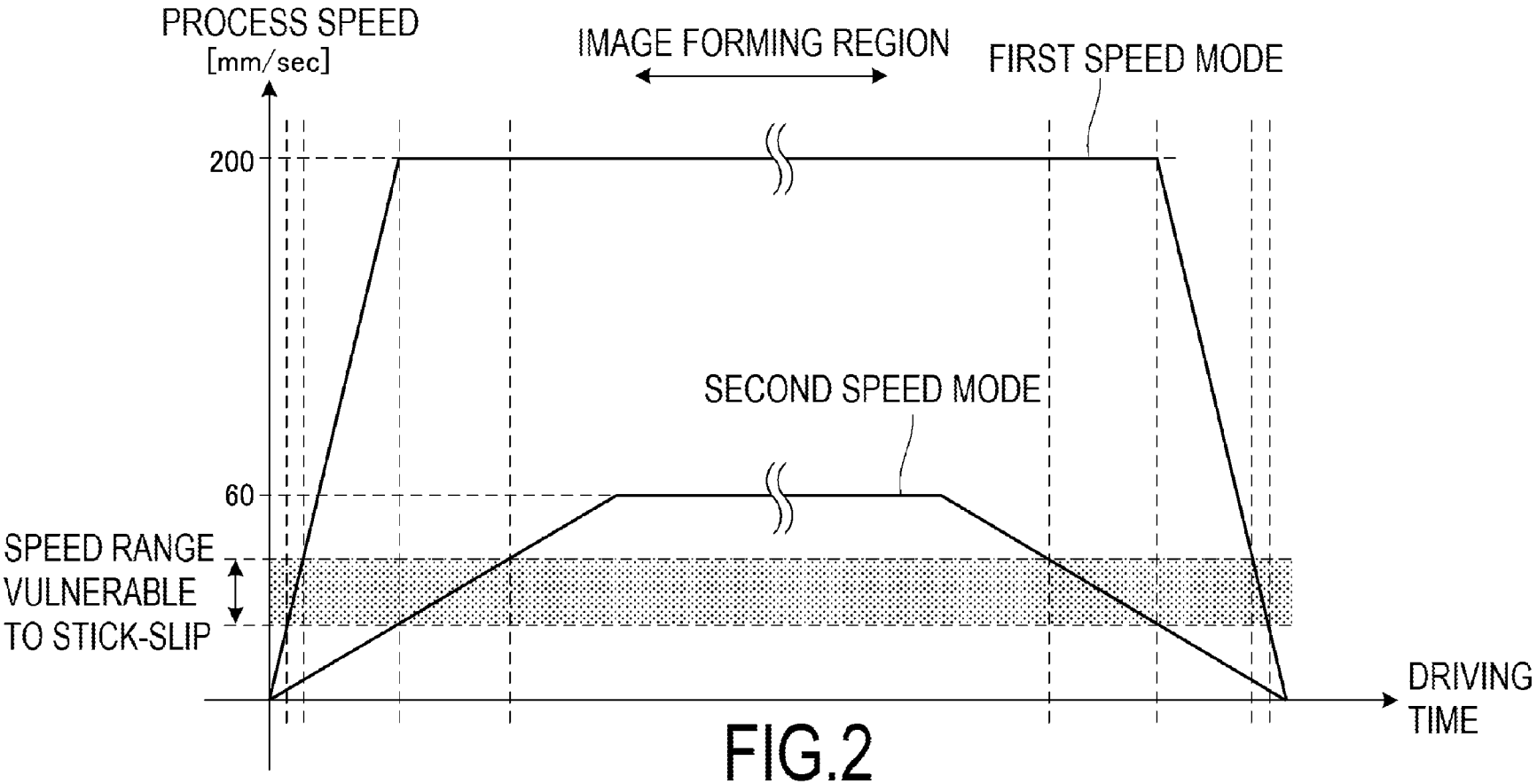
FIG. 2 is a diagram depicting the change of the peripheral speed of a photosensitive drum with respect to the driving time according to Example 1.

The effect of this example was verified using a comparative example, which has a configuration where the intermediate transfer belt and the primary transfer roller are separated from the photosensitive drum when the intermediate transfer belt is driven and when the intermediate transfer belt Table 3 shows the generation level of the abnormal sound generated between the cleaning blade and the photosensitive drum in this example and in the comparative example. FIG. 2 shows a state of change of the peripheral speed of the photosensitive drum 11 with respect to the driving time when the process speed is the first speed and the second speed respectively.

In the comparative example, no abnormal sound was generated from the start of driving to the stop of driving when the image formation is executed at the first speed.

However, when the image formation is executed at the second speed, abnormal sound at B level was generated in the period from the start of driving to the start of image formation, and abnormal sound at C level was generated in the period from the end of image formation to the stop of driving.

This is probably because the low speed rotation time, which is vulnerable to stick-slip of the cleaning blade, continued for a long time, in the period from the start of driving to the start of image formation, and in the period from the end of image formation to the stop of driving (see FIG. 2). No abnormal sound was generated in the speed range during the image formation.

In this example, on the other hand, no abnormal sound was generated at all from the start of driving, image formation, to the stop of driving regardless whether the process speed is the first speed or the second speed.

TABLE 3

| | First speed (200 mm/sec) | | | Second speed (60 mm/sec) | | |
|---|---|---|---|---|---|---|
| | Driving start | During image formation | Driving stop | Driving start | During image formation | Driving stop |
| Comparative example | A | A | A | B | A | C |
| This example | A | A | A | A | A | A |

As described above, according to this example, the photosensitive drum 11 is contacting with the primary transfer roller 35 via the intermediate transfer belt 31 in a process speed range where the stick-slip of the cleaning blade 16*a* easily occurs, even if this is outside the image forming time. Therefore, even if the stick-slip of the cleaning blade 16*a* is generated and the cleaning blade 16*a* hits the photosensitive drum 11, the generation of abnormal sound between the cleaning blade 16*a* and the photosensitive drum 11 can be reduced.

In this example, the case when the second speed of the process speed is the low speed mode, and abnormal sound is generated by stick-slip on the low speed side was described. However, a speed range where abnormal sound is generated by stick-slip is not limited to the low speed side. Abnormal sound may be generated when the stick-slip of the cleaning member is generated and the cleaning member hits the photosensitive drum, but the speed range in which abnormal sound is generated is different depending on the specifications of the image forming apparatus. In other words, the speed range in which the stick-slip of the cleaning member occurs is different depending on the specifications of the image forming apparatus, such as the hardness and the shape of the cleaning blade, the surface friction coefficient of the photosensitive drum, the surface property of the photosensitive drum, and the set value of the process speed.

Therefore, in the case of performing the contacting operation or the separating operation of the primary transfer roller to/from the photosensitive drum when the process speed is in the speed range in which stick-slip is generated, the driving of the intermediate transfer belt, the primary transfer roller, and the photosensitive drum is stopped respectively, as mentioned above. In this way, when the generation of abnormal sound caused by the stick-slip of the cleaning member is of concern, the generation of abnormal sound can be reduced by applying the present invention.

If voltage for image formation is applied to the photosensitive drum 11 when the photosensitive drum 11 and the intermediate transfer belt 31 are in the contacting state and the driving of the photosensitive drum 11 is stopping, the following is of concern. That is, potential non-uniformity (Vd non-uniformity, memory) may be generated in a portion of the photosensitive drum 11 that is contacting the intermediate transfer belt 31.

In this example, however, in the case of executing image formation at the second speed, voltage for the image formation is applied to the photosensitive drum 11 after driving of the photosensitive drum 11 is started when the photosensitive drum 11 and the intermediate transfer belt 31 are in the contacting state. After the image formation, the voltage applied to the photosensitive drum 11 is stopped before the driving of the photosensitive drum 11 is stopped. Thereby the above mentioned generation of potential non-uniformity can be reduced.

In this example, the intermediate transfer belt 31 and the photosensitive drum 11 constitute the primary transfer portion T1 by the primary transfer roller 35 and the photosensitive drum 11 in contact with each other via the intermediate transfer belt 31, but the present invention is not limited to this. For example, a member for transferring a toner image from the photosensitive drum 11 to the intermediate transfer belt 31 when an electric field is generated may be disposed in a position facing the photosensitive drum 11, as a member corresponding to the primary transfer roller 35. The photosensitive drum and the intermediate transfer belt may be contacted or separated by the movement of this member.

The present invention can also be suitably applied to a configuration without the primary transfer roller 35, where current is supplied from the power supply, which applies voltage to the secondary transfer roller 36, in the circumferential direction of the intermediate transfer belt 31, to the primary transfer portion T1 of each image forming portion. In this configuration, the power supply to apply voltage to the secondary transfer member can also be used as the power supply to supply voltage to each primary transfer portion for performing the primary transfer, hence a power supply dedicated to the primary transfer is unnecessary, and cost can be reduced.

In the case of the configuration that does not include the primary transfer roller 35, the roller used as the stretching member, to stretch the intermediate transfer belt 31, may be configured to be movable, or a roller may be disposed to be movable in the inner circumference side of the intermediate transfer belt 31. By changing the position of the portion of the intermediate transfer belt 31 that faces the photosensitive drum 11 using the movement of such a roller, the intermediate transfer belt 31 and the photosensitive drum 11 can be contacted or separated.

Further, in this example, the case of using the cleaning blade as the cleaning member was described, but the present invention is not limited to this. The present invention can be suitably applied to any case when there is concern that the cleaning blade that is used may generate abnormal sound with the photosensitive drum due to stick-slip.

In this example, the image forming apparatus based on the intermediate transfer system was described, but the present invention is not limited to this. The present invention can also be suitably applied to a direct transfer type image forming apparatus that includes a carrying belt that bears and carries a recording material (recording material bearing member) as the belt member. In the direct transfer type image forming apparatus, a toner image formed on the surface of each photosensitive drum is directly transferred in sequence to the recording material, which is carried (borne and carried) to each image forming portion by the carrying belt, whereby a color image is recorded.

In the case of the direct transfer type image forming apparatus, the toner image is transferred to the recording material, which is borne and carried by the carrying belt, and the image forming ends. Then the recording material, on which the toner was transferred, is borne and carried by the carrying belt, and at a timing after the recording material is separated from the carrying belt, the driving of the photosensitive drum and the carrying belt stops. Such an image forming apparatus is already known, hence further description is omitted.

The present invention can also be suitably applied to an image forming apparatus where a toner image is directly transferred from the photosensitive drum to a recording material while bearing and carrying the recording material by a transfer portion formed between the photosensitive drum and the transfer member, without including the belt member. The present invention can also be suitably applied to a monochrome image forming apparatus.

Example 2

Example 2 will now be described. In this example, configuration and processing that are different from Example 1 are described, and description on configuration and processing that are the same as Example 1 is omitted.

Figure 3A:
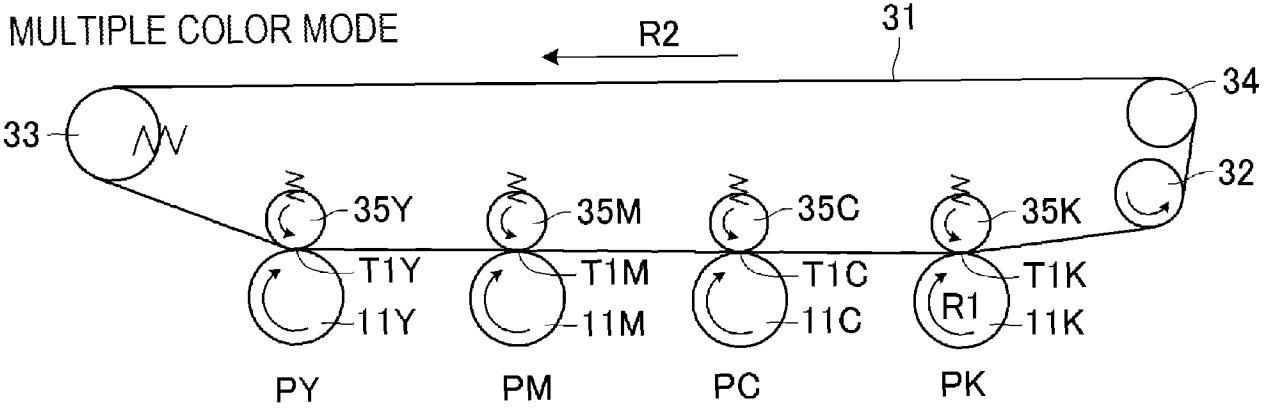
FIG. 3A and FIG. 3B are schematic diagrams depicting the positional relationship of a photosensitive drum, an intermediate transfer belt and a primary transfer roller.
Figure 3B:
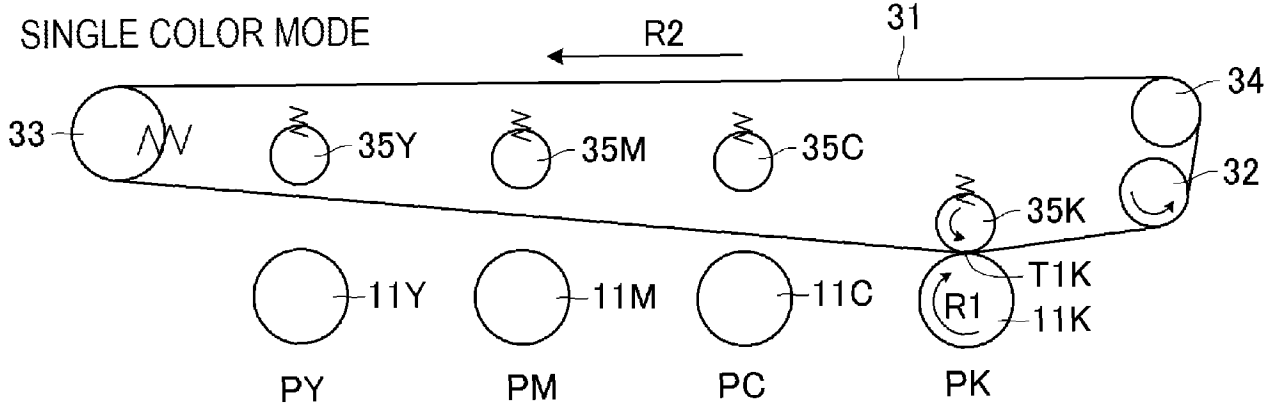

An image forming apparatus 100 of this example has a multiple color mode for forming a full color image, and a single color for forming a monochrome image, and is configured to be able to execute these two modes. FIG. 3A and FIG. 3B are schematic diagrams depicting the positional relationship (contacting or separating state) of the photosensitive drum 11, the intermediate transfer belt 31 and the primary transfer roller 35, where FIG. 3A shows a case of executing image formation in the multiple color mode, and FIG. 3B shows a case of executing image formation in the single color mode.

The multiple color mode is a mode for forming a full color image using a plurality of photosensitive drums, 11Y, 11M, 11C and 11K, when the primary transfer is performed. As shown in FIG. 3A, in the multiple color mode, each primary transfer roller 35Y, 35M, 35C and 35K and each photosensitive drum 11Y, 11M, 11C and 11K contact with each other respectively via the intermediate transfer belt 31 in each image forming portion P. Thereby each primary transfer portion T1Y, T1M, T1C and T1K is formed and image formation is executed in this state. In this mode, in each primary transfer portion T1Y, T1M, T1C and T1K, the toner image is primarily transferred from each photosensitive drum 11Y, 11M, 11C and 11K to the intermediate transfer belt 31 respectively. Here the photosensitive drum 11K corresponds to the first image bearing member, and the photosensitive drums 11Y, 11M and 11C correspond to the second image bearing members other than the first image bearing member.

The single color mode, on the other hand, is a mode for forming a monochrome image using only the photosensitive drum 11K, out of the plurality of photosensitive drums when the primary transfer is performed.

As shown in FIG. 3B, in the single color mode, image formation is executed in the state of the primary transfer rollers 35Y, 35M and 35C being separated from the photosensitive drums 11Y, 11M and 11C, and the primary transfer roller 35K contacting with the photosensitive drum 11K in each image forming portion P. At this time, in the primary transfer portion T1K, the toner image is primarily transferred from the photosensitive drum 11K to the intermediate transfer belt 31. In the single color mode, the primary transfer rollers 35Y, 35M and 35C are separated from the photosensitive drums 11Y, 11M and 11C, thereby the portions of the intermediate transfer belt 31 facing the photosensitive drums 11Y, 11M and 11C are also separated from the respective photosensitive drums. As a result, the primary transfer portions T1Y, T1M and T1C are not formed, and scraping of the surfaces of the photosensitive drums 11Y, 11M and 11C by the intermediate transfer belt 31 can be minimized. As mentioned above, the contacting and separating operations of the primary transfer roller 35 according to this example have two patterns, as shown in Table 4.

TABLE 4

| Mode | Transfer roller contacting state | Apparatus operation state |
|---|---|---|
| Multiple color mode | All contacting | During full color image creation |
| Single color mode | Only Bk is contacting | During monochrome image formation |

Now a case of continuously forming a full color image and a monochrome image during image formation of this example, that is, a case of executing the single color mode continuously after executing the multiple color mode, will be described.

Figure 4A:
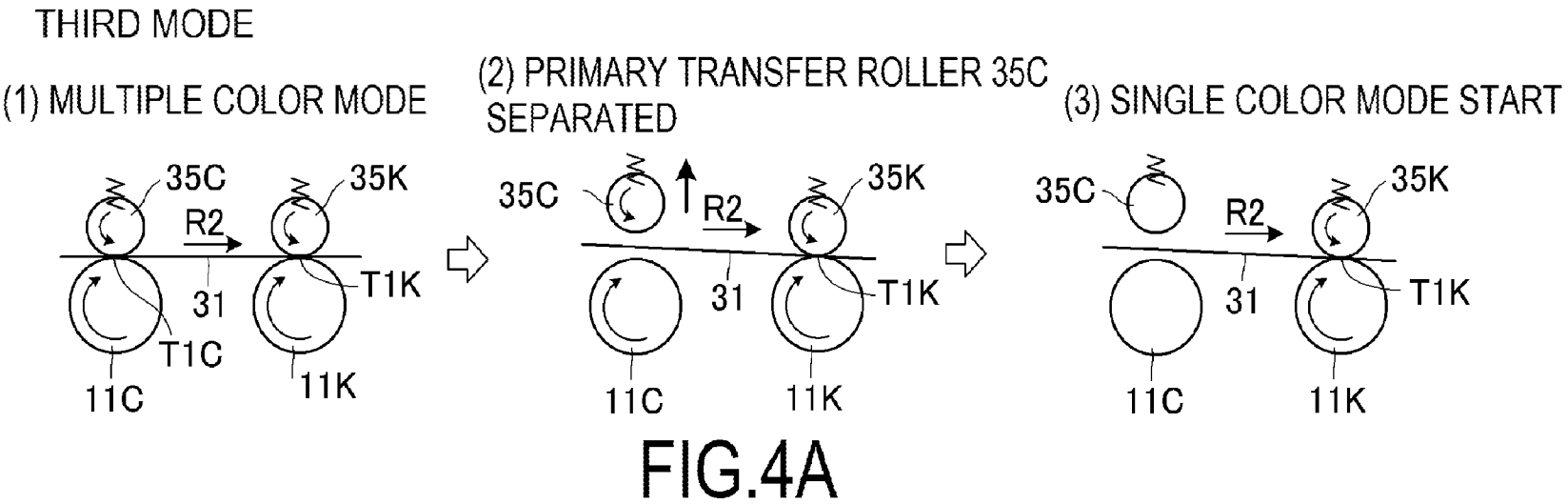
FIG. 4A and FIG. 4B are diagrams depicting the case when a single color mode is performed continuously after a multiple color mode.
Figure 4B:
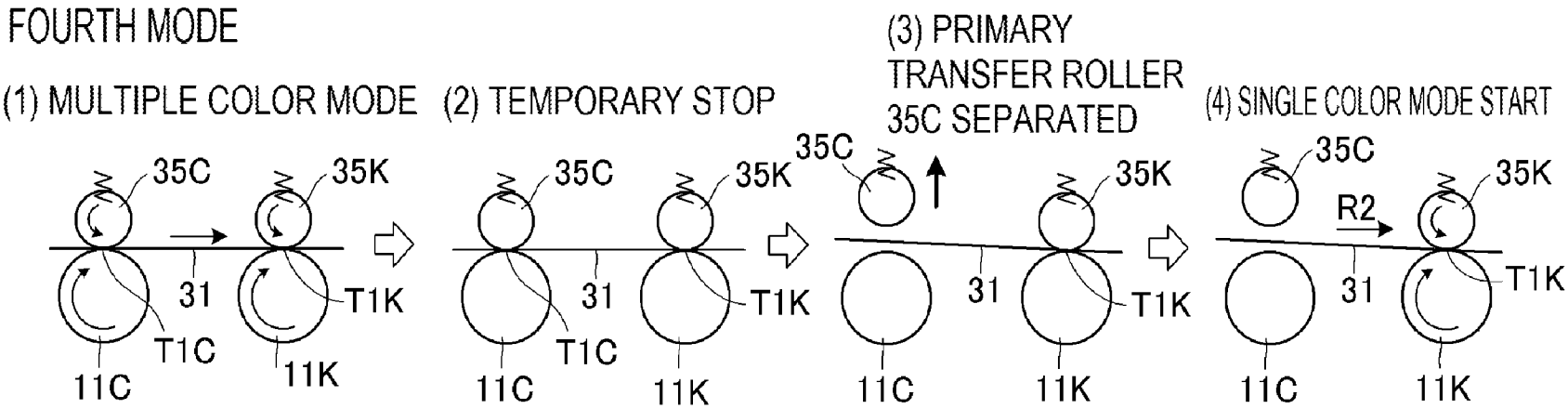

FIG. 4A and FIG. 4B are diagrams depicting the case of continuously executing the single color mode after executing the multiple color mode, where FIG. 4A shows a case when the process speed is the first speed (200 mm/sec), and FIG. 4B shows a case when the process speed is the second speed (60 mm/sec).

When the process speed is the first speed, the following operation is performed at the timing of switching the multiple color mode to the single color mode.

That is, after the image formation in the multiple color mode ends, the primary transfer rollers 35Y, 35M and 35C move in a direction away from the photosensitive drums 11Y, 11M and 11C in the state that the intermediate transfer belt 31 continues rotating. Thereby the intermediate transfer belt 31 and the photosensitive drums 11Y, 11M and 11C are separated. At this time, the primary transfer roller 35K does not move, hence the intermediate transfer belt 31 and the photosensitive drum 11K remain in the contacting state, without being separated. In this state, the monochrome image is formed (FIG. 4A, hereafter called "third mode"). In this example, the driving of the primary transfer rollers 35Y, 35M and 35C and the driving of the photosensitive drums 11Y, 11M and 11C are stopped at this time.

When the process speed is the second speed, the following operation is performed at the timing of switching the multiple color mode to the single color mode.

That is, after the image formation in the multiple color mode ends, all the driving temporarily stops while in the state of the primary transfer rollers 35Y, 35M, 35C and 35K contacting with the photosensitive drums 11Y, 11M, 11C and 11K via the intermediate transfer belt 31. By the primary transfer rollers 35Y, 35M and 35C moving in the direction away from the photosensitive drums 11Y, 11M and 11C in this state, the intermediate transfer belt 31 is separated from the photosensitive drums 11Y, 11M and 11C. Then the driving is started while the primary transfer roller 35K remains contacting the photosensitive drum 11K via the intermediate transfer belt 31. In this state, the monochrome image is formed (FIG. 4B, hereafter called "fourth mode"). In this example, the driving of the primary transfer rollers 35Y, 35M and 35C and the driving of the photosensitive drums 11Y, 11M and 11C are stopped at this time.

Now a case of continuously forming a monochrome image and a full color image during image formation, that is, a case of continuously executing the multiple color mode after executing the single color mode, will be described.

When the process speed is the first speed, at the timing of switching the multiple color mode to the single color mode, first of all the primary transfer rollers 35Y, 35M and 35C move in the direction of contacting the photosensitive drums 11Y, 11M and 11C in the state that the intermediate transfer belt 31 continues rotating. Thereby the intermediate transfer belt 31 contacts the photosensitive drums 11Y, 11M and 11C. As a result, the primary transfer rollers 35Y, 35M, 35C and 35K contact the photosensitive drums 11Y, 11M, 11C and 11K, respectively, via the intermediate transfer belt 31, whereby the primary transfer portions T1Y, T1M, T1C and T1K are formed. In this state, the full color image is formed (the third mode).

When the process speed is the second speed, on the other hand, all the driving temporarily stops at the timing of switching the single color mode to the multiple color mode, in the state where the primary transfer roller 35K and the photosensitive drum 11K remain contacting via the intermediate transfer belt 31. By the primary transfer rollers 35Y, 35M and 35C moving in the direction of contacting the photosensitive drums 11Y, 11M and 11C, the primary transfer rollers 35Y, 35M and 35C contact with the photosensitive drums 11Y, 11M and 11C, respectively, via the intermediate transfer belt 31.

As a result, the primary transfer rollers 35Y, 35M, 35C and 35K contact with the photosensitive drums 11Y, 11M, 11C and 11K, respectively, via the intermediate transfer belt 31, whereby the primary transfer portions T1Y, T1M, T1C and T1K are formed. In this state, all the driving is restarted, and the full color image is formed (hereafter called "fifth mode").

The experiment results will be shown below to describe the effect of this example.

The effect of this example was verified using a comparative example, which has a configuration where the multiple color mode is switched to the single color mode, and the single color mode is switched to the multiple color mode (only in the third mode), while the intermediate transfer belt continuously rotates so as not to drop throughput.

A durability test was performed in a 15° C. and 10% RH (L/L) environment by intermittently (two sheets at a time) printing 20,000 sheets of horizontal lines (1% image ratio). When 20,000 sheets are printed, five sheets of horizontal line images (2% image ratio) are formed at the first speed and the second speed respectively (a total of ten sheets) in the sequence from the multiple color mode to the single color mode.

Table 5 shows the contacting or the separating state between the intermediate transfer belt 31 and the photosensitive drum 11 of this example and the comparative example, at each timing of switching from the multiple color mode to the single color mode, and from the single color mode to the multiple color mode.

In the comparative example, the multiple color mode and the single color mode are switched in the third mode, whether the process speed is the first speed or the second speed. In this example, on the other hand, the multiple color mode and the single color mode are switched in the third mode when the process speed is the first speed. When the process speed is the second speed, the multiple color mode is switched to the single color mode in the fourth mode, and the single color mode is switched to the multiple color mode in the fifth mode.

TABLE 5

| | First speed (200 mm/sec) | | Second speed (60 mm/sec) | |
|---|---|---|---|---|
| | Multiple color → single color | Single color → multiple color | Multiple color → singe color | Single color → multiple color |
| Comparative example | Third mode | | Third mode | |
| This example | Third mode | | Fourth mode | Fifth mode |

Table 6 shows the generation level of the abnormal sound generated between the cleaning blade and the photosensitive drum at the timing of the multiple color mode switching to the single color mode, and the timing of the single color mode switching to the multiple mode respectively in this example, and in the comparative example.

In the comparative example, when the image formation is executed at the first speed, the abnormal sound was not generated at the timing of the multiple color mode switching to the single color mode, and the timing of the single color mode switching to the multiple color mode. However, when the image formation is executed at the second speed, an abnormal sound at C level was generated when the photosensitive drum 11K of the image forming portion PK is stopped or driven at the timing of the multiple color mode switching to the single color mode, and the timing of the single color mode switching to the multiple color mode. No abnormal sound was generated during the image formation.

In this example, on the other hand, no abnormal sound was generated at the timing of the multiple color mode switching to the single color mode, and the timing of the single color mode switching to the multiple color mode, whether the process speed was the first speed or the second speed.

TABLE 6

| | First speed (200 mm/sec) | | Second speed (60 mm/sec) | |
|---|---|---|---|---|
| | Multiple color → single | Single color → multiple color | Multiple color → single | Singe color → multiple color |
| Comparative example | A | A | C | C |
| This example | A | A | A | A |

As described above, according to this example, the following control is performed only when the time of the speed range of the process speed, in which the generation of stick-slip of the cleaning blade is of concern, is long.

At the timing of the multiple color mode switching to the single color mode, driving is stopped in a state where the photosensitive drums 11Y, 11M, 11C and 11K and the primary transfer rollers 35Y, 35M, 35C and 35K remain in contact via the intermediate transfer belt 31. In this driving stop state, the primary transfer rollers 35Y, 35M and 35C and the intermediate transfer belt 31 are separated from the photosensitive drums 11Y, 11M and 11C. Then driving is restarted while the photosensitive drum 11K and the primary transfer roller 35K remain in contact via the intermediate transfer belt 31. At the timing of the single color mode switching to the multiple color mode, driving is stopped in a state where the photosensitive drum 11K and the primary transfer roller 35K remain in contact via the intermediate transfer belt 31. In this driving stop state, the primary transfer rollers 35Y, 35Y and 35C are contacted with the photosensitive drums 11Y, 11M and 11C via the intermediate transfer belt 31. Then driving is restarted while the photosensitive drums 11Y, 11M, 11C and 11K and the primary transfer rollers 35Y, 35M, 35C and 35K remain in contact via the intermediate transfer belt 31. In this way, when the generation of stick-slip of the cleaning blade is of concern, the photosensitive drum 11 is contacting with the primary transfer roller 35 via the intermediate transfer belt 31, hence the generation of an abnormal sound can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-072439, filed Mar. 31, 2015, which is hereby incorporated by reference herein in its entirety.

What is claimed is:

1. An imaging forming apparatus comprising:

an image bearing member configured to bear a developer image;

a cleaning member that is disposed so as to contact with the image bearing member and is configured to clean a surface of the image bearing member;

a belt member that is disposed so as to be able to contact with or separate from the image bearing member, and form a transfer portion together with the image bearing member when contacting with the image bearing member;

contacting and separating means for setting a positional relationship between the belt member and the image bearing member to be in a contacting state, where the belt member and the image bearing member contact with each other, or in a separating state, where the belt member and the image bearing member are separate from each other; and control means for controlling the contacting and separating means so as to switch between the contacting state and the separating state, wherein image formation is able to be executed in a first mode exhibiting a first peripheral speed of the image bearing member and a second mode exhibiting a second peripheral speed of the image bearing member, which is different from the first peripheral speed, the image formation is executed after driving of the image bearing member is started, and the driving of the image bearing member is stopped after the image formation is ended, and wherein during a period from the start of the driving of the image bearing member to the start of the image formation, or during a period from the end of the image formation to the stop of the driving of the image bearing member, the control means controls the contacting and separating means such that (i) in a case where the image formation is executed when in the first mode, the contacting and separating means is in the separating state, and (ii) in a case where the image formation is executed when in the second mode, the contacting and separating means is in the contacting state.

2. The image forming apparatus according to claim 1, wherein in case where image formation is executed when in the second mode, the control means controls the contacting and separating means such that the contacting and separating means is in the separating state before the start of driving of the image bearing member, and the contacting and separating means is in the contacting state when the driving of the image bearing member is started, and when the driving of the image bearing member is stopped after the image formation, the driving of the image bearing member is stopped while maintaining the contacting state during the image formation, and the control means controls the contacting and separating means to be in the separating state after the driving of the image bearing member is stopped.

3. The image forming apparatus according to claim 1, wherein in the case where image formation is executed when in the second mode, voltage for the image formation is applied to the image bearing member after the driving of the image bearing member is started, and voltage application to the image bearing member is stopped after the image formation is executed and before the driving of the image bearing member is stopped.

4. The image forming apparatus according to claim 1, wherein the cleaning member is a blade having elasticity, which is disposed so as to contact with the image bearing member in a counter direction to the rotating direction of the image bearing member.

5. The image forming apparatus according to claim 1, wherein the belt member is an endless belt.

6. The image forming apparatus according to claim 1, wherein the image bearing member is disposed in plural and, wherein the plural image bearing members are lined up along a rotating direction of the belt member.

7. The image forming apparatus according to claim 1, wherein the belt member is an intermediate transfer belt onto which the transfer portion primarily transfers a developer image from the image bearing member, and the developer image primarily transferred onto the intermediate transfer belt is secondarily transferred to a recording medium between the intermediate transfer belt and a secondary transfer member.

8. The image forming apparatus according to claim 7, further comprising a plurality of movable primary transfer members disposed so as to face image bearing members, respectively, via the intermediate transfer belt when the intermediate transfer belt and the image bearing members are in the contacting state, wherein the contacting and separating means sets the intermediate transfer belt and the image bearing members to be in the separating state or in the contacting state by moving the primary transfer members.

9. The image forming apparatus according to claim 7, further comprising a movable stretching member configured to stretch the intermediate transfer belt, wherein the contacting and separating means sets the intermediate transfer belt and the image bearing member to be in the separating state or the contacting state by moving the stretching member.

10. An image forming apparatus according to claim 1, wherein the belt member is a carrying belt configured to bear and carry a recording material, and a developer image is transferred, in the transfer portion, from the image bearing member to the recording material which is borne and carried by the carrying belt.

11. The image forming apparatus according to claim 1, wherein one of the first mode and the second mode is alternatively selected depending on a recording material to which the developer image formed on the image bearing member is transferred via the belt member.

12. The image forming apparatus according to claim 11, wherein one of the first mode and the second mode is alternatively selected depending on a thickness of the recording material.

13. An image forming apparatus comprising:

an image bearing member configured to bear a developer image;

a cleaning member that is disposed so as to contact with the image bearing member and is configured to clean a surface of the image bearing member;

a belt member that is disposed so as to be able to contact with or separate from the image bearing member, and form a transfer portion together with the image bearing member when contacting with the image bearing member;

contacting and separating means for setting a positional relationship between the belt member and the image bearing member to be in a contacting state, where the belt member and the image bearing member contact with each other, or in a separating state, where the belt member and the image bearing member are separate from each other; and control means for controlling the contacting and separating means so as to switch between the contacting state and the separating state, wherein the image bearing member is disposed in plural, and wherein image formation is able to be executed in one mode among:

a multiple color mode in which image formation is executed by the plural image bearing members in a state where the plural image bearing members are contacting with the belt member; and a single color mode in which image formation is executed by a first image bearing member, among the plural image bearing members, in a state where the first image bearing member is contacting with the belt member, and in a state where a second image bearing member, which is an image bearing member other than the first image bearing member among the plurality of image bearing members, is separated from the belt member, and in the case where image formation is continuously executed in the single color mode after the multiple color mode, driving of the plural image bearing members and the belt member is temporarily stopped in the state in which the plural image bearing members contact with the belt member after the image formation in the multiple color mode is ended, then the second image bearing member and the belt member are separated, and then driving of the first image bearing member and the belt member is restarted in the state where the first image bearing member remains in contact with the belt member, whereby image formation in the single color mode is executed.

14. An image forming apparatus comprising:

an image bearing member configured to bear a developer image;

a cleaning member that is disposed so as to contact with the image bearing member and is configured to clean a surface of the image bearing member;

a belt member that is disposed so as to be able to contact with or separate from the image bearing member, and form a transfer portion together with the image bearing member when contacting with the image bearing member;

contacting and separating means for setting a positional relationship between the belt member and the image bearing member to be in a contacting state, where the belt member and the image bearing member contact with each other, or in a separating state, where the belt member and the image bearing member are separate from each other; and control means for controlling the contacting and separating means so as to switch between the contacting state and the separating state, wherein the image bearing member is disposed in plural, and wherein image formation is able to be executed in one mode among:

a multiple color mode in which image formation is executed by the plural image bearing members in a state where the plural image bearing members are contacting with the belt member; and a single color mode in which image formation is executed by a first image bearing member, among the plural image bearing members, in a state where the first image bearing member is contacting with the belt member, and in the state where a second image bearing member, which is an image bearing member other than the first image bearing member among the plural image bearing members, is separated from the belt member, and in the case where image formation is continuously executed in the multiple color mode after the single color mode, driving of the first image bearing member and the belt member is temporarily stopped in the state in which the first image bearing member contacts with the belt member after the image formation in the single color mode is ended, then the second image bearing member and the belt member contact with each other, and then driving of the first image bearing member, the second image bearing member and the belt member is restarted in the state where the first image bearing member and second image bearing member contact with the belt member, whereby image formation in the multiple color mode is executed.

15. An image forming apparatus comprising:

an image bearing member configured to bear a developer image;

a cleaning member that is disposed so as to contact with the image bearing member and is configured to clean a surface of the image bearing member;

a transfer member that is disposed so as to be capable of contacting with or separating from the image bearing member, and form a transfer portion together with the image bearing member when contacting with the image bearing member; and contacting and separating means for setting a positional relationship between the transfer member and the image bearing member to be in a contacting state where the transfer member and the image bearing member contact with each other, or in a separating state where the transfer member and the image bearing member are separate from each other; and control means for controlling the contacting and separating means so as to switch between the contacting state and the separating state, wherein image formation is able to be executed in a first mode exhibiting a first peripheral speed of the image bearing member and a second mode exhibiting a second peripheral speed of the image bearing member, which is different from the first peripheral speed, the image formation is executed after driving of the image bearing member is started, and the driving of the image bearing member is stopped after the image formation is ended, and wherein during a period from the start of the driving of the image bearing member to the start of the image formation, or during a period from the end of the image formation to the stop of the driving of the image bearing member, the control means controls the contacting and separating means such that (i) in a case where the image formation is executed when in the first mode, the contacting and separating means is in the separating state, and (ii) in a case where the image formation is executed when in the second mode, the contacting and separating means is in the contacting state.

16. The image forming apparatus according to claim 15, wherein the transfer member is a transfer roller.

17. The image forming apparatus according to claim 15, wherein in a case where image formation is executed when in the second mode, the control means controls the contacting and separating means such that the contacting and separating means is in the separating state before the start of the driving of the image bearing member, and the contacting and separating means is in the contacting state when the driving of the image bearing member is started, and when the driving of the image bearing member is stopped after the image formation, the driving of the image bearing member is stopped while maintaining the contacting state during the image formation, and the control means controls the contacting and separating means to be in the separating state after the driving of the image bearing member is stopped.

18. The image forming apparatus according to claim 15, wherein in the case where image formation is executed when in the second mode, the voltage for the image formation is applied to the image bearing member after the driving of the image bearing member is started, and voltage application to the image bearing member is stopped after the image formation is executed and before the driving of the image bearing member is stopped.

19. The image forming apparatus according to claim 15, wherein the cleaning member is a blade having elasticity, which is disposed so as to contact with the image bearing member in a counter direction to the rotating direction of the image bearing member.

20. The image forming apparatus according to claim 15, wherein one of the first mode and the second mode is alternatively selected depending on a recording material to which the developer image formed on the image bearing member is transferred via the transfer member.

21. The image forming apparatus according to claim 20, wherein one of the first mode and the second mode is alternatively selected depending on a thickness of the recording material.

* * * * *